United States Patent [19]

Frisbee

[11] Patent Number: 4,487,269

[45] Date of Patent: Dec. 11, 1984

[54] DOZER BLADE ANGLE ADJUSTMENT MECHANISM

[75] Inventor: Claude M. Frisbee, Bettendorf, Iowa

[73] Assignee: J. I. Case Company, Racine, Wis.

[21] Appl. No.: 487,796

[22] Filed: Apr. 22, 1983

[51] Int. Cl.[3] ..... E02F 3/76

[52] U.S. Cl. ..... 172/818; 403/108

[58] Field of Search ..... 172/818, 820, 821, 822, 172/823, 819; 403/108, 107

[56] References Cited

U.S. PATENT DOCUMENTS

| | | | |
|---|---|---|---|
| 2,452,408 | 10/1948 | Washbond | 172/823 |
| 2,651,860 | 9/1953 | Mork | 172/823 |
| 2,838,857 | 6/1958 | Allin | 172/823 |
| 2,943,407 | 7/1960 | Long | 172/821 |
| 3,628,612 | 12/1971 | Liess | 172/821 |
| 3,656,559 | 4/1972 | Lennea | 172/818 |
| 3,662,838 | 5/1972 | Polzin | 172/823 |
| 4,023,624 | 5/1977 | Frisbee | 172/823 |
| 4,217,963 | 8/1980 | Freese | 172/818 |

*Primary Examiner*—Richard J. Johnson

*Attorney, Agent, or Firm*—Cullen, Sloman, Cantor, Grauer, Scott & Rutherford

[57] ABSTRACT

An angle adjustment mechanism for an implement mounted on a vehicle, such as a bulldozer having a C-shaped frame which pivotally supports the dozer blade at the forward end of the vehicle for angled movement. The side frame portions include slide members mounted on rails which are pivotally interconnected with one of the opposed sides of the implement. The rails each include a plurality of spaced horizontal slots or openings at predetermined locations, and the channel-shaped slide members each include a downwardly opening slot which is alignable with one of the openings in the rails. The slide members are locked to fix the angled position of the implement by horizontally oriented tapered anchor pins receivable through the slot in the slide member and one of the aligned openings in the rails.

8 Claims, 4 Drawing Figures

DOZER BLADE ANGLE ADJUSTMENT MECHANISM

FIELD AND BACKGROUND OF THE INVENTION

The present invention relates to an angle adjustment mechanism for an implement mounted on a vehicle, and more particularly to means for adjusting the blade of a bulldozer or the like about the vertical axis of the blade.

The angle adjustment mechanism of the present invention will be described herein with reference to bulldozers having a generally vertical blade, however it is understood that the angle adjustment mechanism of the present invention may also be utilized for manually adjusting the angled position of various vehicle mounted implements. The blade of the present commercial angling bulldozer is generally supported on a U or C-shaped frame. The blade is pivotally or universally supported at the forward end of the dozer on the mid-portion of the frame. The frame extends generally horizontally on opposed sides of the dozer and is pivotally supported on the dozer at its opposed ends as shown in U.S. Pat. No. 2,943,407 of Long, assigned to the assignee of the present invention.

Manually adjustable bulldozer blades are generally provided with posts or apertures in the side portions of the frame and the struts pivotally supporting the sides of the blade are secured to one of these connectors. The blade angle is adjusted by releasing the struts, rotating the blade about its vertical axis by engaging the ground or an obstacle, and securing the struts to different connectors on the side frame members.

The prior art also includes a number of manual angle adjustment mechanisms having slide members mounted on rails extending along the side portions of the frame. The slide members are interconnected to the sides of the blade by struts and turnbuckles, and the blade may be angled by extending one slide member forwardly and the opposed slide member rearwardly. The slide members are fixed at predetermined locations on the rails by anchor pins or the like. Examples of prior art manual adjustment mechanisms include U.S. Pat. Nos. 3,628,612, 3,656,559, 3,662,838 and 4,217,963.

As set forth in the disclosures of the above referenced prior art patents, it is often difficult to manually adjust the angled position of the blade because the blade must be accurately aligned to secure the blade in position or the anchor pins may bind and become locked in position. The solution to these problems suggested by the prior art require complicated assemblies, including multiple anchor pins for each slide member. The angle adjustment mechanism of the present invention solves these problems, without complicating the assembly, at minimal cost.

SUMMARY OF THE INVENTION

As described, the angle adjustment mechanism of the present invention is particularly, although not exclusively, adapted for use in a conventional manual angling dozer, including wheeled and track bulldozers. A conventional dozer includes a C-frame having a forward portion which supports a blade or other implement and side portions which extend along the sides of the vehicle and which are pivotally supported at the rearward ends to the vehicle. The blade is generally pivotally or universally supported at the midportion of the frame and the sides of the blade are pivotally connected to the side portions of the frame. In the preferred embodiments of conventional angling dozers, the side portions of the blade are pivotally connected by extensible struts to slide members which are slidably mounted on rails extending longitudinally on the side frame portions. In a manual angling dozer, stop means, such as anchor pins, are provided to fix the slide members at predetermined locations on the slide rails. The blade may then be angled about a vertical axis through the center pivot connection by extending one slide member toward the blade and the opposed slide member rearwardly. This is generally accomplished by removing the slide member anchor pins, engaging one corner of the blade against a ground obstacle, rotating the blade and fixing the blade in a new location by resetting the anchor pins.

In the angle adjustment mechanism of the present invention, each of the rails include a plurality of spaced horizontal openings extending through the rails generally perpendicular to their longitudinal axis. Each of the slides include a horizontal opening, which may be aligned with an opening in the slide rail, as described. In the preferred embodiment of the invention, the anchor pins are tapered or wedge-shaped, such that the maximum dimension of the anchor pin is greater than the minimum dimension of the openings in the slides and guide rails, the final alignment between the openings may then be accomplished by driving the tapered anchor pin into the generally aligned openings. Further, the anchor pin may be released, when the angle of the blade is to be changed, by hitting or knocking the smaller end of the tapered anchor pins, releasing the wedged engagement. In the most preferred embodiment, the opening in the slide member is also tapered, facititating alignment and removal of the anchor pins.

In the most preferred embodiment, the slide members each include a C-shaped channel portion, which is slidably received on the rail, having opposed inwardly extending end portions which retain the slide members on the rails. The opening in the slide member is defined by a downwardly opening slot or channel through the end portions of the channel, defining an opening through each of the end portions, which receives the tapered anchor pin. As described, in the preferred embodiment, the slot or slots in the slide member are tapered to conform to the tapered anchor pins, facilitating alignment and release of the pins. In the disclosed embodiment, the channel portion of the slide members each include a laterally extending embossment, aligned with and adjacent the slot, which recieves the smaller end of the anchor pin. The slide embossment and the end of the anchor pin include alignable apertures for receipt of a vertical retainer pin. The slide member preferably includes an enlarged top portion which slidably receives the channel-shaped portion of the slide member. In the disclosed embodiment, the slide member is T-shaped, including a vertical portion, which is welded or otherwise secured to the top portion of the side frame portions, and a horizontal portion, which slidably receives the channel portion of the slide, securely retaining the slide member for sliding movement, as described.

The horizontal arrangement of the openings in the slide members and rails and the tapered anchor pins provide several important advantages over the prior art. First, as described, the tapered anchor pins, particularly in combination with the tapered slots in the slide members, assist alignment of the slides on the rails, reducing the difficult problem of accurately aligning a heavy doser blade in the field. Second, the horizontal orientation of the tapered anchor pins assist removal, which may be accomplished by hitting the smaller end of the anchor pins, which extends beyond the openings, with a hammer or the like. The tapered anchor pins are more easily removed. Other advantages and meritorious features of the present invention will be more fully understood from the following description of the preferred embodiments, the claims and the appended drawings, a brief description of which follows.

DESCRIPTION OF THE PREFERRED EMBODIMENTS

Figure 1:
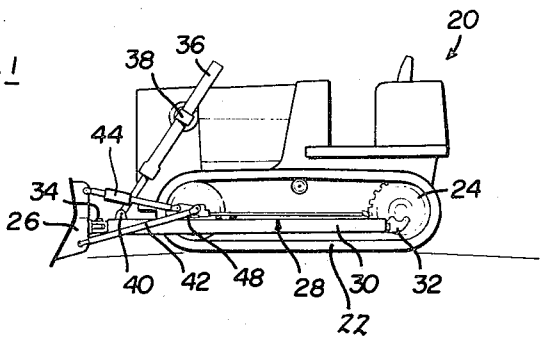
FIG. 1 is a side view of a conventional bulldozer which includes the improved angle adjustment mechanism of the present invention.

FIG. 1 illustrates a conventional bulldozer 20, having one embodiment of the blade angle adjustment mechanism of the present invention, and which includes an endless track 22 which is driven by drive sprocket 24. The assembly includes a generally vertical blade 26 which is supported on a conventional C-shaped generally horizontal frame 28. The C-shaped frame includes side portions 30 which are pivotally supported at their rearward ends by trunnion brackets 32. The blade 26 is supported at the forward end of the frame by a center universal or pivotal connection 34, which may be a ball-type universal joint or a pivotal connection having perpendicular pivot pins. The bulldozer blade in the disclosed embodiment may be raised or lowered by hydraulic lift cylinders 36 having a cylinder portion which is pivotally supported on the dozer chassis by trunnion mountings 38. In the disclosed embodiment, the rod ends of the lift cylinders are pivotally connected to the forward end of the C-frame by pivotal connections 40 on both sides of the dozer. The blade may thus be raised or lowered by retracting or extending lift cylinders 36, which raise or lower the forward portion of the C-frame 28 about the pivotal connections 32 of the frame.

As described in more detail hereinbelow, each side of the blade is connected to a slide assembly 48 on the side portions 30 of the frame by a strut assembly. In the disclosed embodiment, each side of the blade is pivotally connected to the slide assembly by lower struts 42 and upper extensible struts 44. In a conventional manual angling dozer, the upper struts 44 are manually extensible turnbuckles. As described, the angle adjustment mechanism and slide assembly of this invention may also be utilized with wheeled vehicles, including plows, and various vehicle mounted implements.

Figure 2:
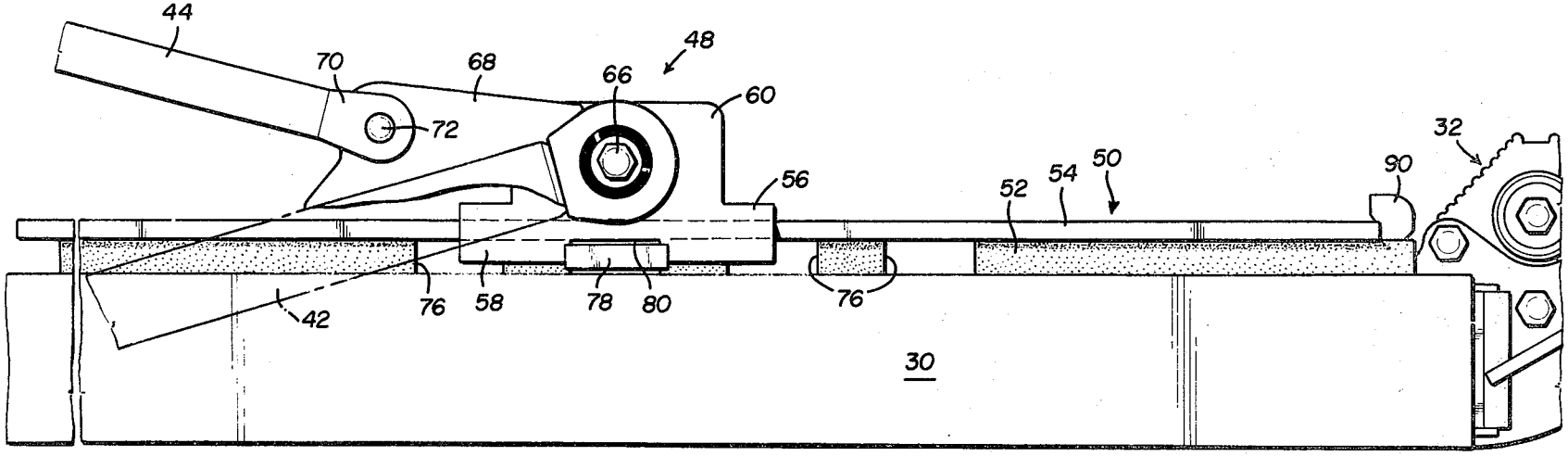
FIG. 2 is an enlarged side view of the C-frame and the preferred embodiment of the angle adjustment mechanism of this invention.
Figures 3, 4:
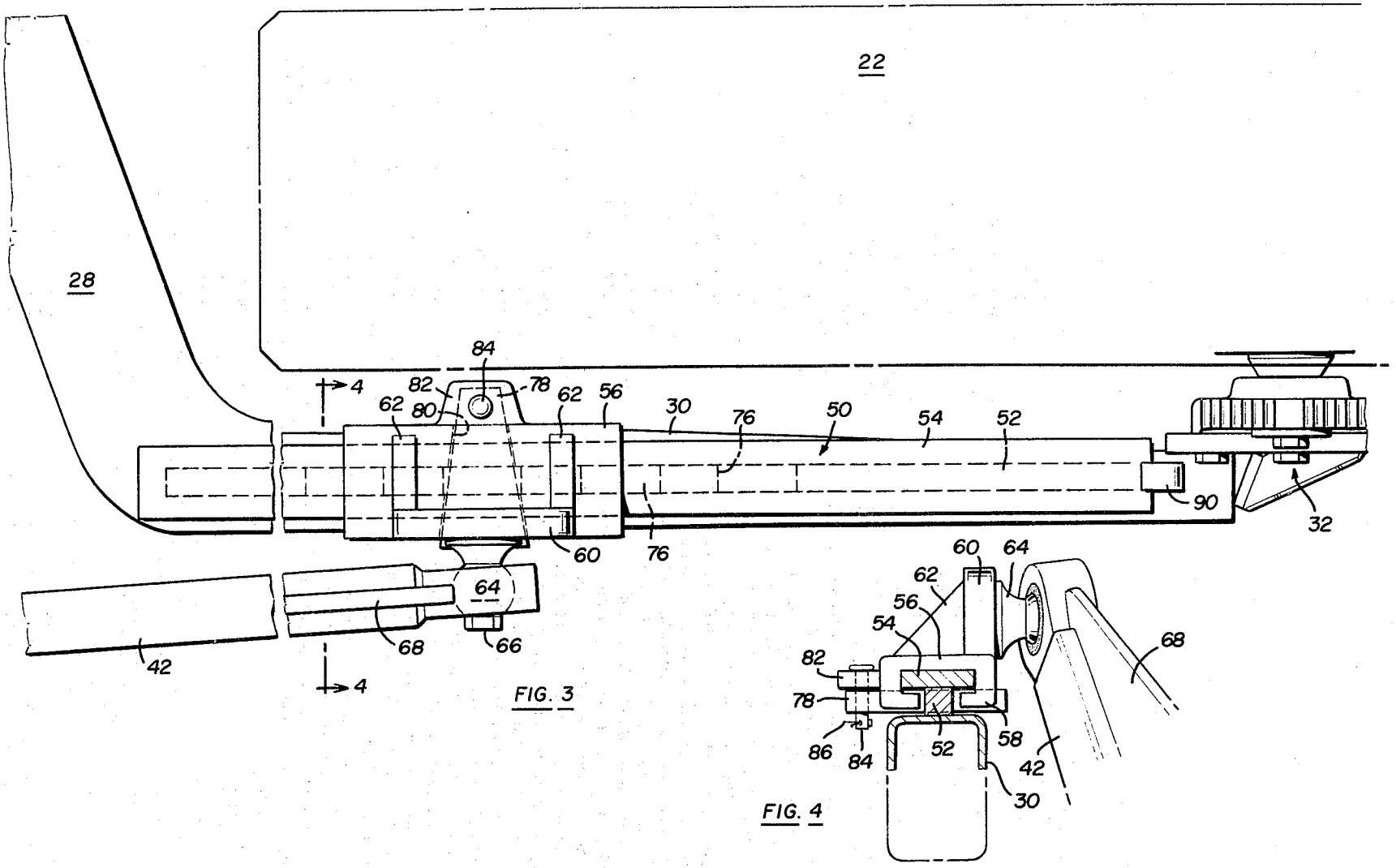
FIG. 3 is a top view of the assembly shown in FIG. 2.
FIG. 4 is a cross-sectional view of the angle adjustment mechanism as shown in FIG. 3, in the direction of view arrows 4–4.

As best shown in FIGS. 2–4, a T-shaped track or rail 50 is mounted on the side portions 30 of the C-frame. In the disclosed embodiment, the rails each include a vertical portion 52, which may be welded or otherwise secured to the C-frame, and an upper horizontal portion 54, which may be welded or otherwise secured to the vertical portion 52. The slide assembly 48 preferably includes a C-shaped channel portion 56 having inwardly extending end portions 58 which securely retain the slide member on the rail for sliding movement, as best shown in FIG. 4. The disclosed embodiment of the slide member also includes a vertical member 60 and triangular support web portions 62, which are welded or otherwise secured to the top of the channel portion 56 of the slide member. In the disclosed embodiment, a univeral ball member 64 is welded or otherwise secured to the vertical member 60, which is received in a ball socket on the end portion of the lower strut 42 for universal movement of the struts during movement of the blade. The lower struts are retained on the ball member 64 by a nut 66 which is threadably received on a threaded shank on the end of the ball member, not shown. In the disclosed embodiment, a bracket embossment 68 is welded or otherwise secured to the top portion of the lower struts 42 for pivotal connection of the upper extensible struts 44. In the disclosed embodiment, the upper struts 44 each include a bifurcated end portion 70 which is pivotally connected to the bracket embossment 68 by a pivot pin 72. As described more fully hereinbelow, the blade may thus be angled about a vertical axis through universal or pivotal connection 34 by extending one slide member 48 and retracting the opposed slide member.

In the preferred embodiment of the angle adjustment mechanism of this invention, the rails each include a plurality of spaced horizontal openings 76 at predetermined locations along the rails. The openings preferably extend through the vertical portion 52 of the rail, as best shown in FIG. 2. The slide members 48 are then retained at one of the pre-selected locations by tapered or wedge-shaped anchor pins 78, as shown in FIGS. 2–4. In the most preferred embodiment, the channel portions 56 of the slide members each include a downwardly opening slot or channel 80 which extends through the inwardly extending end portions 58 of the channel, as best shown in FIGS. 2 and 4. As shown in FIG. 4, the slots 80 through the end portions of the channel are preferably tapered to conform to the taper of the anchor pins 78. The anchor pins are retained in place as follows. The channel portions 56 of the slide members each include a horizontal, laterally extending embossment 82, which is located above and aligned with the slots 80 in the slide member. The smaller end of the wedge-shaped anchor pin and the embossment 82 each include alignable apertures which receive a headed retainer pin 84, as best shown in FIG. 4. The retainer pin may be retained in place by a conventional cotter pin 86 or the like.

The angle of the blade 26 is then adjusted by first removing the anchor pins 78. Because the anchor pins and preferably the slot 80 in the slide member 48 are tapered or wedge-shaped, the anchor pins may be easily removed by removing the retainer pins 84 and striking the smaller end of the anchor pins 78 with a mallet or the like. After the anchor pins are removed, the blade may be angled to one of the desired positions, dictated by the openings 76 in the guide rails, by engaging a lower corner of the blade with the ground or an obstacle, and moving the bulldozer until the slide member opening 80 is generally aligned with one of the openings 76 in the rail. As described, exact alignment is difficult because of the weight of the dozer blade 26 and the limited movement of the dozer. This has been a problem with the prior art manual angling dozers, which require substantially exact orientation of the slide member on the rail. Exact orientation is not, however, required with the angle adjustment mechanism of the present invention because of the wedge-shaped anchor pins. When the slot 80 in the slide member 48 is approximately aligned with one of the openings 76 in the rail, the wedge-shaped anchor pin 78 may be driven in place by a mallet or the like, which will move the slide member and the slot 80 into exact alignment with one of the horizontal rail openings 76. Thus, the angling adjustment mechanism of the present invention facilitates both removal of the anchor pins and alignment of the slide member on the rails without requiring a complex assembly or multiple anchor pins for each slide member.

In the disclosed embodiment, the rail includes four openings 76 through the vertical portion 52 of the rails, providing four angled positions for the dozer blade. A stop 90 is provided at the rearward end of the rails to prevent over-travel of the slide member. It will be understood, however, that any suitable number of openings may be provided in the rail for angled adjustment of the blade. Further, various modifications may be made to the angle adjustment mechanism of this invention to accommodate the implement to be angled and the details of the slide mechanism and the disclosed assembly is adapted to the particular application of a manual bulldozer blade angling mechanism.

I claim:

1. An angle adjustment mechanism for an implement mounted on a vehicle, the assembly including a frame pivotally supporting said implement at one end of said vehicle for angled movement about a vertical axis of said implement, said frame including side frame portions on opposed sides of said vehicle, slide members slidably mounted on rails supported on each of said side frame portions, strut means interconnecting each of said slide members with one side of said implement and anchor pin means locking said slide members at preselected locations on said side frame portions, whereby said implement may be angled by relatively moving said slide members, the improvement comprising: said rails each including a plurality of spaced horizontal openings extending therethrough generally perpendicular to the longitudinal axis of said rails, said slide members each having a horizontal opening slidably alignable with one of said rail openings, and said anchor pin means being wedged-shaped and receivable in said aligned openings, said wedge-shaped anchor pin means each having an enlarged end of greater dimension than said aligned openings, whereby said slide members may be locked at preselected locations on said rails for angled adjustment of said implement, each of said rails being generally T-shaped comprising a vertical portion joined to said side frame portion and a top horizontal portion which slidably receives said slide member, said horizontal rail openings extending through said vertical slide portions, and said slide members each having a downwardly opening C-shaped channel portion slidably received on one of said T-shaped rails and said slide member openings defined by downwardly opening aligned slots in the ends of said slide member channel portions.

2. The angle adjustment mechanism defined in claim 1, characterized in that the length of said wedge-shaped anchor pin means is greater than the length of said aligned slots, said slide members each including a horizontal laterally extending embossment aligned with and adjacent said slot which receives the smaller end of said wedge-shaped anchor pin means, and said slide embossments and said smaller anchor pin end having alignable apertures for receipt of a vertical retainer pin.

3. An angle adjustment mechanism for a generally vertical blade mounted on a vehicle, the assembly including a generally C-shaped frame, said frame including side frame portions on opposed sides of said vehicle pivotally supported at its opposed ends to said vehicle, said blade pivotally mounted at the forward end of said vehicle on said frame for angled movement about a vertical axis of said blade, slide rails mounted on each of said side frame portions, slide members slidably mounted on said rails, strut means pivotally interconnecting each of said slide members with one side of said blade, said rails each having a plurality of spaced horizontal slots, said slide members each having a horizontal slot alignable with one of said rail slots, and tapered anchor pins receivable in the aligned openings in said rail and slide members, said anchor pins having a maximum width greater than the width of said aligned openings, and retainer means retaining said anchor pins in said aligned openings, and said slide members each including a downwardly opening C-shaped channel portion which is slidably received on said rails, said slide member channel portions each having opposed inwardly extending end portions retaining said slide members on said rails, and said slide member slots defined by downwardly opening channels in said slide member channel end portions.

4. The angle adjustment mechanism defined in claim 3, characterized in that said slide member channels are tapered to correspond with the taper of said tapered anchor pins.

5. The angle adjustment mechanism defined in claim 4, characterized in that said rails are generally T-shaped, including a vertical portion joined to said side frame portions and a top horizontal portion which slidably receives said C-shaped channel portions of said slide members and said slots extending through said vertical rail portions.

6. An angle adjustment mechanism for a dozer blade mounted on a vehicle, the assembly including a C-shaped generally horizontal frame having a central portion pivotally supporting said blade for angled movement about a vertical axis of said blade and side portions extending on opposed sides of said vehicle pivotally supported on said vehicle, slide rails mounted on said frame side portions, slide members having a downwardly opening C-shaped channel portion slidably mounted on each of said rails, said slide member channel portions each including inwardly extending opposed end portions retaining said slide members on said rails, each of said slide members interconnected with one of the opposed sides of said dozer blade for angled movement of said blade upon relative movement of said slide members, said rails each including a plurality of spaced horizontal openings extending through said rails at predetermined locations, said slide members each including a slot extending through said channel end portions alignable with said rail openings, and tapered anchor pins receivable in said slide member slots through said rail openings, said anchor pins locking said slide members on said rails at said predetermined locations, thereby fixing the angled position of said dozer blade.

7. The angle adjustment mechanism defined in claim 6, characterized in that each of said rails is generally T-shaped, including a vertical portion joined to said side frame portion and a top horizontal portion which slidably receives said channel slide portion, and said rail openings extending through said vertical slide portions.

8. The angle adjustment mechanism defined in claim 6, characterized in that said slide members each include a horizontal, laterally extending embossment aligned with and adjacent said slot which receives the smaller end of said anchor pin, said slide embossments and said smaller anchor pin end having aligned apertures for receipt of a vertical retainer pin.

* * * * *